US010644459B2

(12) United States Patent
Morello et al.

(10) Patent No.: US 10,644,459 B2
(45) Date of Patent: May 5, 2020

(54) ELECTRICAL CONNECTOR

(71) Applicant: Aptiv Technologies Limited, St. Michael (BB)

(72) Inventors: John R. Morello, Warren, OH (US); James M. Rainey, Warren, OH (US); Faviola Ramon, Saltillo (MX); Dennis Garcia Lepez, Saltillo (MX); Francisco J. Mendez Lopez, Saltillo (MX)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/398,898

(22) Filed: Apr. 30, 2019

(65) Prior Publication Data

US 2019/0296500 A1 Sep. 26, 2019

Related U.S. Application Data

(63) Continuation of application No. 15/927,163, filed on Mar. 21, 2018, now abandoned.

(51) Int. Cl.

| | |
|---|---|
| ***H01R 13/66*** | (2006.01) |
| ***H01R 13/426*** | (2006.01) |
| ***H01R 24/60*** | (2011.01) |
| ***H01R 4/18*** | (2006.01) |
| ***H01R 13/629*** | (2006.01) |
| *H01R 13/64* | (2006.01) |

(52) U.S. Cl.

CPC ..... *H01R 13/6616* (2013.01); *H01R 4/183* (2013.01); *H01R 13/426* (2013.01); *H01R 13/629* (2013.01); *H01R 24/60* (2013.01); *H01R 13/64* (2013.01)

(58) Field of Classification Search

CPC .. H01R 13/6616; H01R 13/629; H01R 13/64; H01R 24/60; H01R 13/426; H01R 4/183

USPC ..... 439/620.04, 620.03

See application file for complete search history.

(56) References Cited

U.S. PATENT DOCUMENTS

| | | | | |
|---|---|---|---|---|
| 4,116,524 | A * | 9/1978 | DeNigris | H01R 13/6608 439/490 |
| 4,345,223 | A * | 8/1982 | Chien-Chun | H01R 13/713 315/3 |
| 4,667,272 | A * | 5/1987 | Fasano | H04Q 1/146 361/119 |
| 4,685,761 | A * | 8/1987 | Locati | H01R 13/187 29/876 |

(Continued)

FOREIGN PATENT DOCUMENTS

| | | | |
|---|---|---|---|
| CA | 1303200 | C | 6/1992 |
| JP | 2006217783 | A | 8/2006 |

*Primary Examiner* — Abdullah A Riyami
*Assistant Examiner* — Vladimir Imas
(74) *Attorney, Agent, or Firm* — Robert J. Myers

(57) ABSTRACT

An electrical connector assembly includes a connector body and an electrical component having wire leads extending axially from each end of the body, and electrical terminals. The wire leads are connected to the terminals. The assembly further includes a retainer housing disposed within the connector body. The retainer housing defines a pair of longitudinal channels in which the terminals are disposed. The retainer housing defies a cradle having an arcuate cross section in which the electrical component is disposed. The retainer housing defines a retaining feature configured to retain the electrical component within the cradle.

15 Claims, 7 Drawing Sheets

(56) References Cited

U.S. PATENT DOCUMENTS

| | | | | | |
|---|---|---|---|---|---|
| 4,725,698 | A | | 2/1988 | Takai et al. | |
| 4,912,452 | A | | 3/1990 | Koleyni | |
| 4,948,376 | A | | 8/1990 | Penning | |
| 4,968,260 | A | * | 11/1990 | Ingalsbe | H01R 31/06 439/638 |
| 5,034,846 | A | * | 7/1991 | Hodge | H01R 13/6666 361/119 |
| 5,167,538 | A | * | 12/1992 | Stoerk | H01R 4/4818 439/173 |
| 5,451,173 | A | * | 9/1995 | Mai | H01R 13/68 439/620.29 |
| 5,733,153 | A | | 3/1998 | Takahashi et al. | |
| 7,140,920 | B1 | * | 11/2006 | Lin | H01R 13/6641 439/620.3 |
| 7,479,044 | B1 | * | 1/2009 | MacCrindle | H01R 13/426 439/699.2 |
| 7,794,283 | B2 | * | 9/2010 | Wang | H01R 13/447 439/651 |
| 9,142,904 | B2 | * | 9/2015 | Martin | H01R 13/40 |
| 10,135,211 | B2 | * | 11/2018 | Lloyd | H01R 24/60 |
| 2011/0136383 | A1 | | 6/2011 | Ohta | |

* cited by examiner

ELECTRICAL CONNECTOR

CROSS-REFERENCE TO RELATED APPLICATION

This application is a continuation application and claims the benefit under 35 U.S.C. § 120 of U.S. patent application Ser. No. 15/927,163, filed Mar. 21, 2018, the entire disclosure of which is hereby incorporated herein by reference.

TECHNICAL FIELD OF THE INVENTION

The invention generally relates to an electrical connector, and more particularly relates to an electrical connector including an electrical component.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

An electrical connector assembly is presented herein. The electrical connector assembly includes a connector body that is configured to interface with a corresponding connector body, The connector body defines a cavity within. The assembly also includes an electrical component, such as a terminating resistor for a differential transmission line, having a generally cylindrical body with a first wire lead extending axially from a first end of the cylindrical body and a second wire lead extending axially from a second end of the cylindrical body. The assembly further includes first and second electrical terminals having attachment portions that are attached to the wire leads and connection portions that are configured to interconnect with corresponding electrical terminals in the corresponding connector body. The first wire lead is connected to the attachment portion of the first electrical terminal and the second wire lead is connected to the attachment portion of the second electrical terminal. The assembly additionally includes a retainer housing that is disposed within the cavity of the connector body. The retainer housing defines a pair of longitudinal channels in which the first and second electrical terminals are disposed. The retainer housing further defines a cradle extending from an inner side wall of the retainer housing having an arcuate cross section in which the electrical component is disposed. The retainer housing also defines a retaining feature that secures the electrical component within the cradle. The retaining features in this example include a pair of parallel flexible arms defining a triangular catch on each free end.

Figure 1:
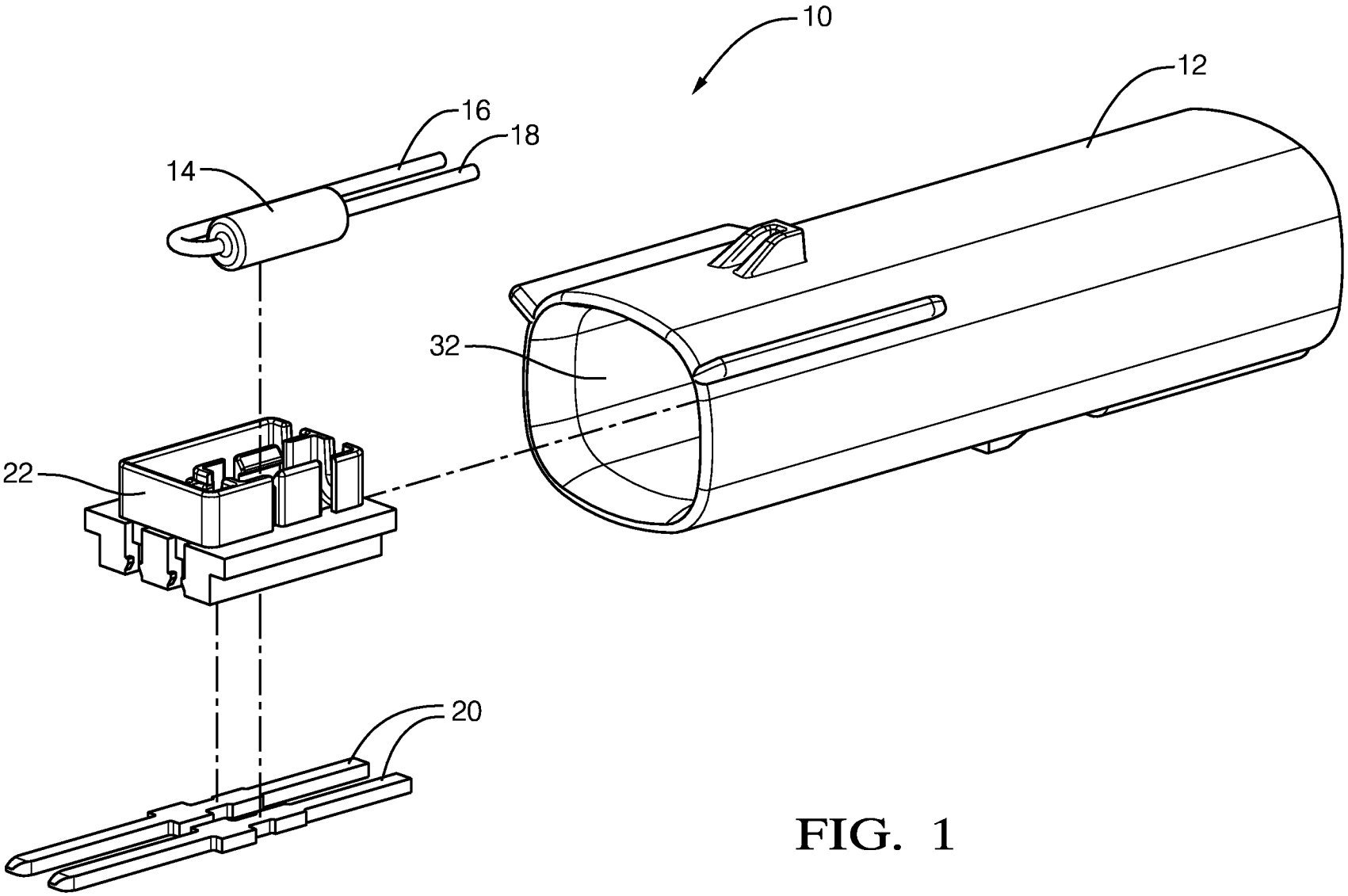
FIG. 1 is an exploded perspective view of an electrical connector assembly in accordance with one embodiment of the invention.
Figure 5:
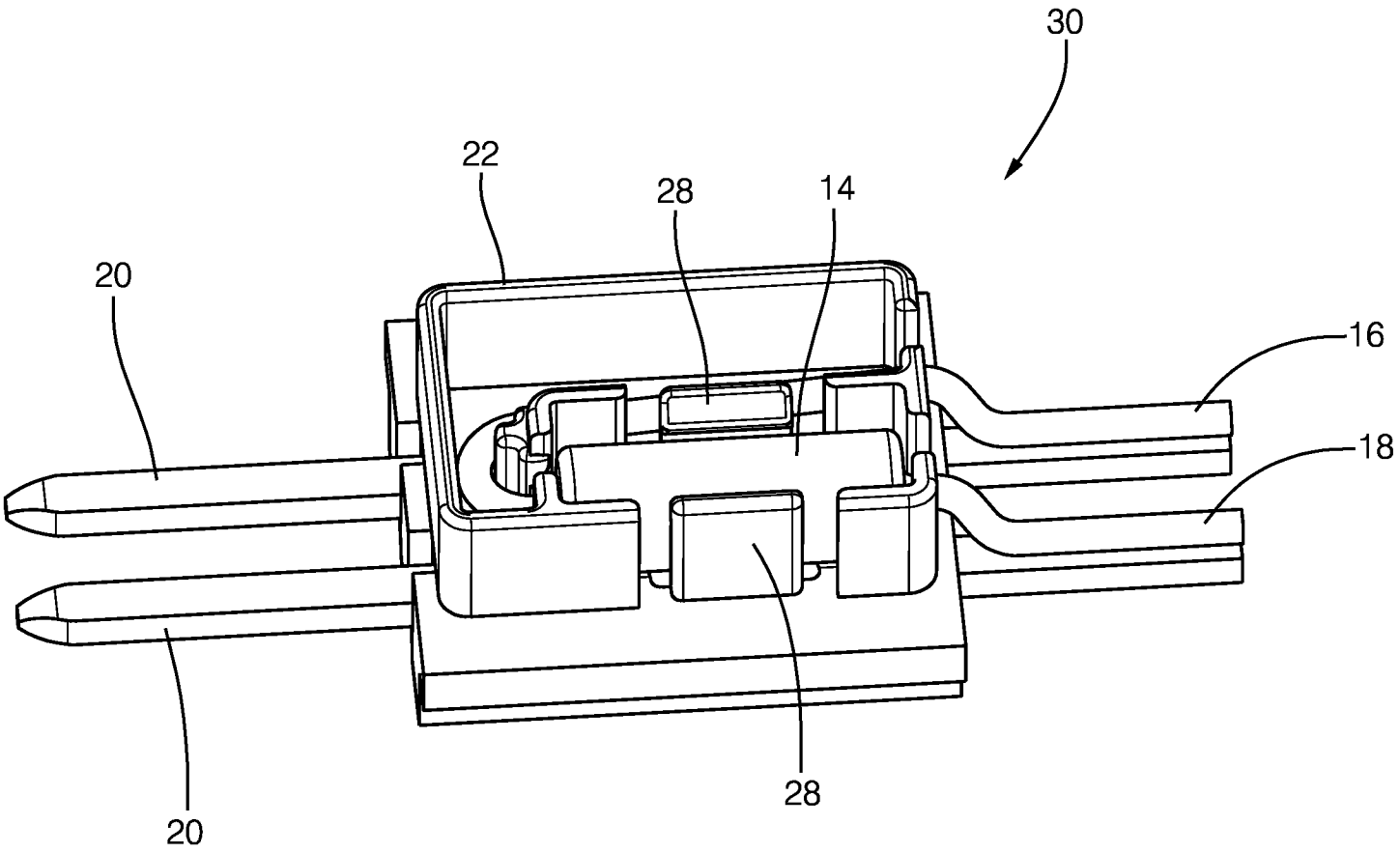
FIG. 5 is a perspective view a retainer subassembly of the electrical connector assembly of FIG. 1 in accordance with one embodiment of the invention.

FIGS. 1-8 illustrate a non-limiting example of an electrical connector assembly, hereinafter referred to as the assembly 10. As shown in FIG. 1, the assembly 10 includes a connector body 12 formed of a dielectric material, such as polybutylene terephthalate (PBT), polypropylene (PP), or polyamide (PA, commonly known as NYLON) using an injection molding process. The assembly 10 also includes an electrical component 14, a resistor in this particular example, having a generally cylindrical body and a first wire lead 16 extending axially from a first end of the cylindrical body and a second wire lead 18 extending axially from a second end of the cylindrical body. Alternative embodiments may include other types of leaded electrical components, such as a diode. The assembly 10 further includes a pair of electrical terminals 20, in this particular example male blade terminals. The electrical terminals 20 may be formed from a sheet of copper-based material using a stamping process. The first wire lead 16 is bent to have a J-shape so that both wire leads 16, 18 are parallel as shown in FIG. 1 so that they are parallel to the attachment portions of the electrical terminals 20 as shown in FIG. 5. Each of the wire leads 16, 18 is individually attached to one of the electrical terminals 20, as best shown in FIG. 5, using a welding process. The welding process may be sonic welding, soldering, or pressure welding (crimping), but the inventors have discovered that resistance welding provides superior results. The electrical component 14 and the electrical terminals 20 are disposed within a retainer housing 22. The retainer housing 22 are made of a dielectric material, such as PBT, PP, or PA and may be formed using an injection molding process. The retainer housing 22 defines a pair of longitudinal channels 24, best shown in FIG. 8, in which the electrical terminals 20 are disposed. The retainer housing 22 also defines a cradle 26, best shown in FIG. 7, having an arcuate cross section in which the electrical component 14 is disposed. The retainer housing 22 further defines a retaining feature 28, also best shown in FIG. 7, having a pair of flexible arms securing the electrical component 14 to the cradle 26.

Figure 2:
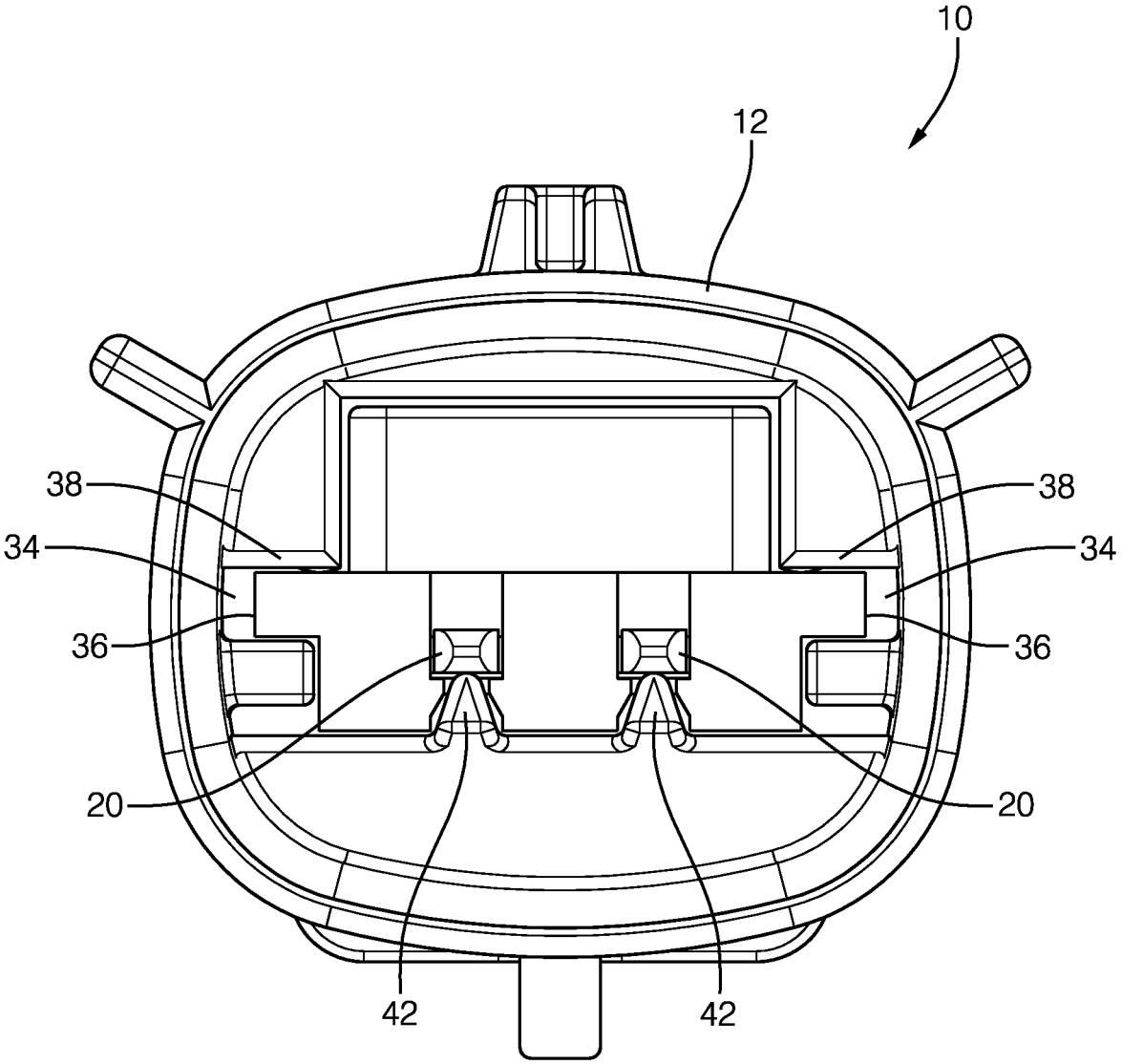
FIG. 2 is an end view of the electrical connector assembly of FIG. 1 prior to deformation of the longitudinal wings in accordance with one embodiment of the invention.
Figure 6:
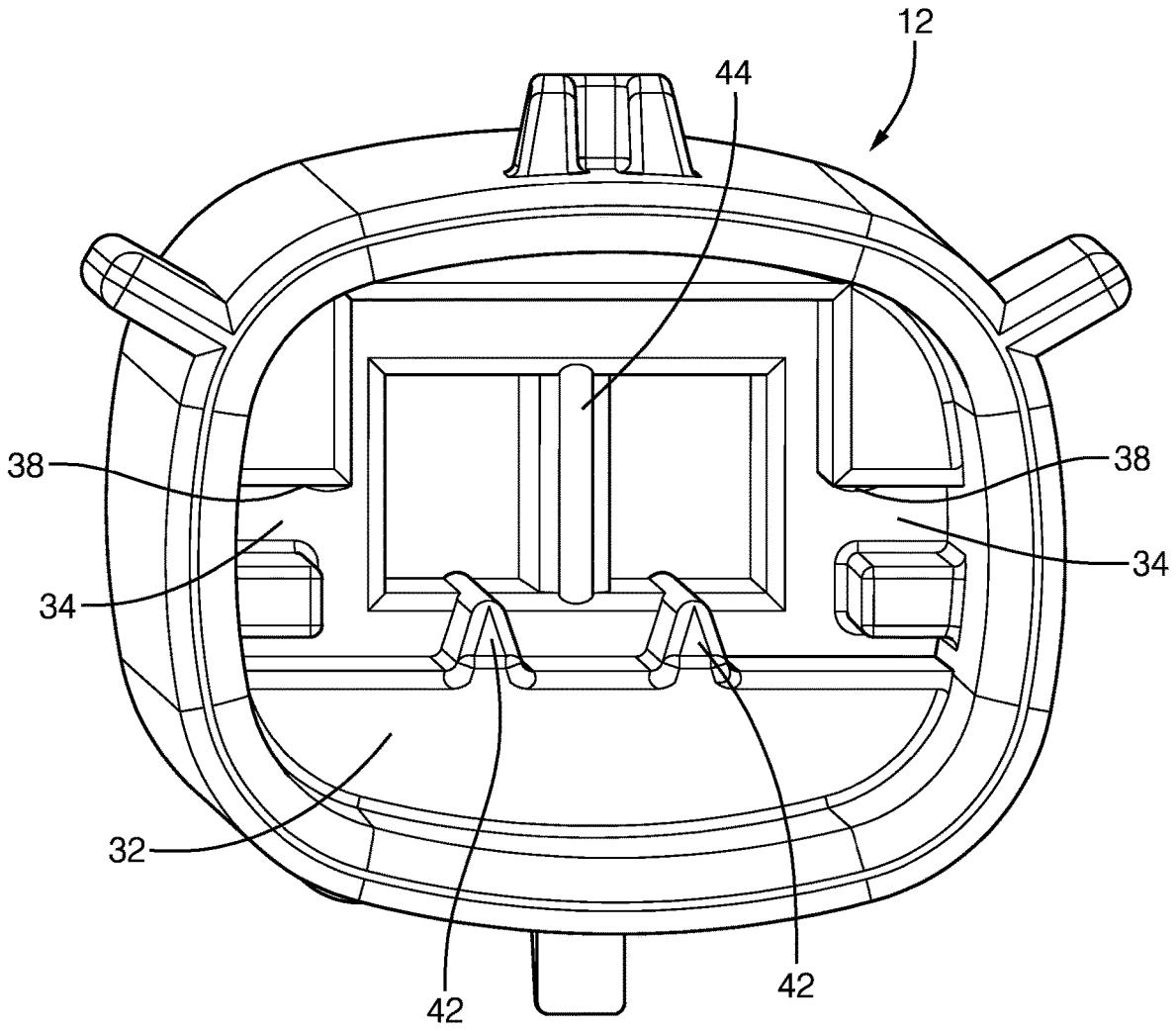
FIG. 6 is an end view of a connector body of the electrical connector assembly of FIG. 1 in accordance with one embodiment of the invention.
Figure 7:
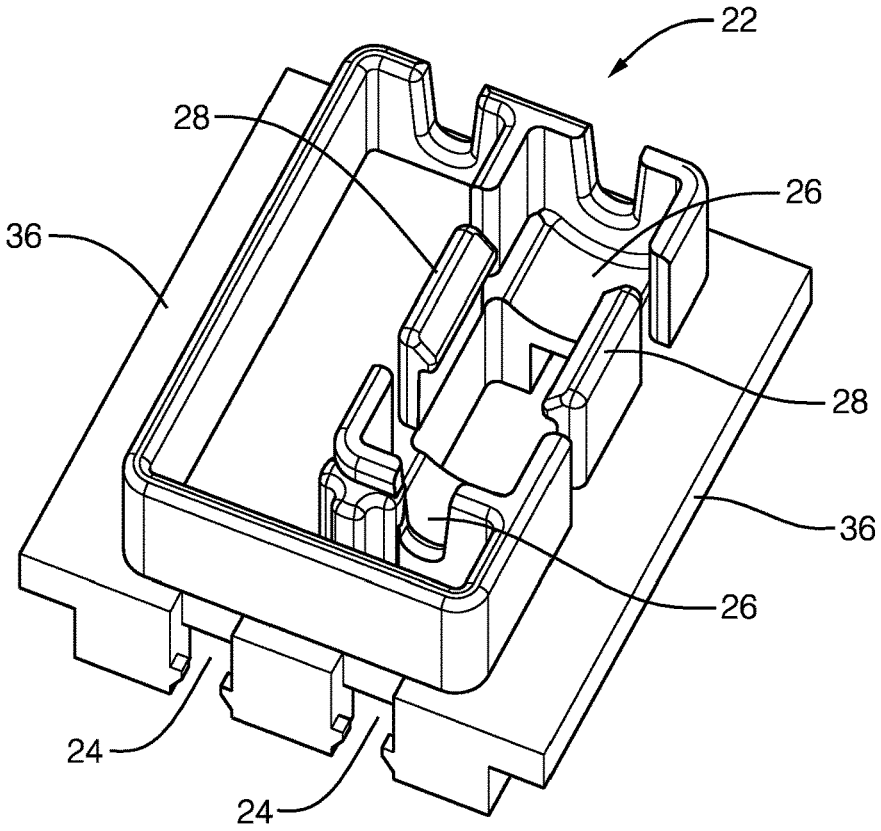
FIG. 7 is a top perspective view a retainer housing of the retainer subassembly of FIG. 5 in accordance with one embodiment of the invention.
Figure 8:
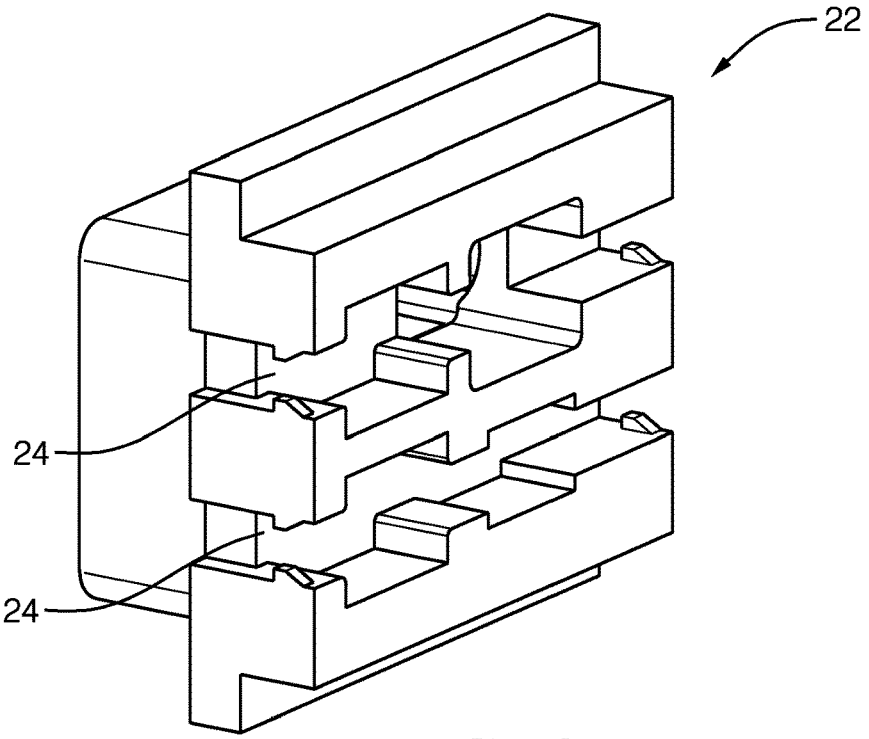
FIG. 8 is a bottom perspective view the retainer housing FIG. 7 in accordance with one embodiment of the invention.

A retainer subassembly 30 including the electrical component 14 and the electrical terminals 20 is disposed within a cavity 32 formed within the connector body 12. Features projecting from the side walls of the cavity form longitudinal grooves 34 as shown in FIG. 6. As shown in FIG. 2, the retainer housing 22 defines a pair of longitudinal wings 36 extending from the adjoining sidewalls of the retainer housing 22 and these longitudinal wings 36 are received within the longitudinal grooves 34 of the connector body 12 to positively locate the retainer subassembly 30 within the connector body 12. The top walls of the longitudinal grooves 34 define thin crush ribs 38 that contact the upper surfaces of the longitudinal wings 36. The crush ribs 38 are in compressive contact with the top walls and the ribs are dimensioned so that they are deformed during the insertion of the longitudinal wings 36 into the longitudinal grooves 34 which biases the lower surfaces of the longitudinal wings 36 to also be in compressive contact with the bottom walls of the longitudinal grooves 34. The interaction of the crush ribs 38 and the longitudinal wings 36 inhibit movement of the retainer subassembly 30 relative to the connector body 12, thereby providing the benefit of improved alignment of the electrical terminals 20 with the connector body 12 which improves the likelihood of proper mating of the electrical terminals 20 and the corresponding terminals in the corresponding connector body.

Figure 3:
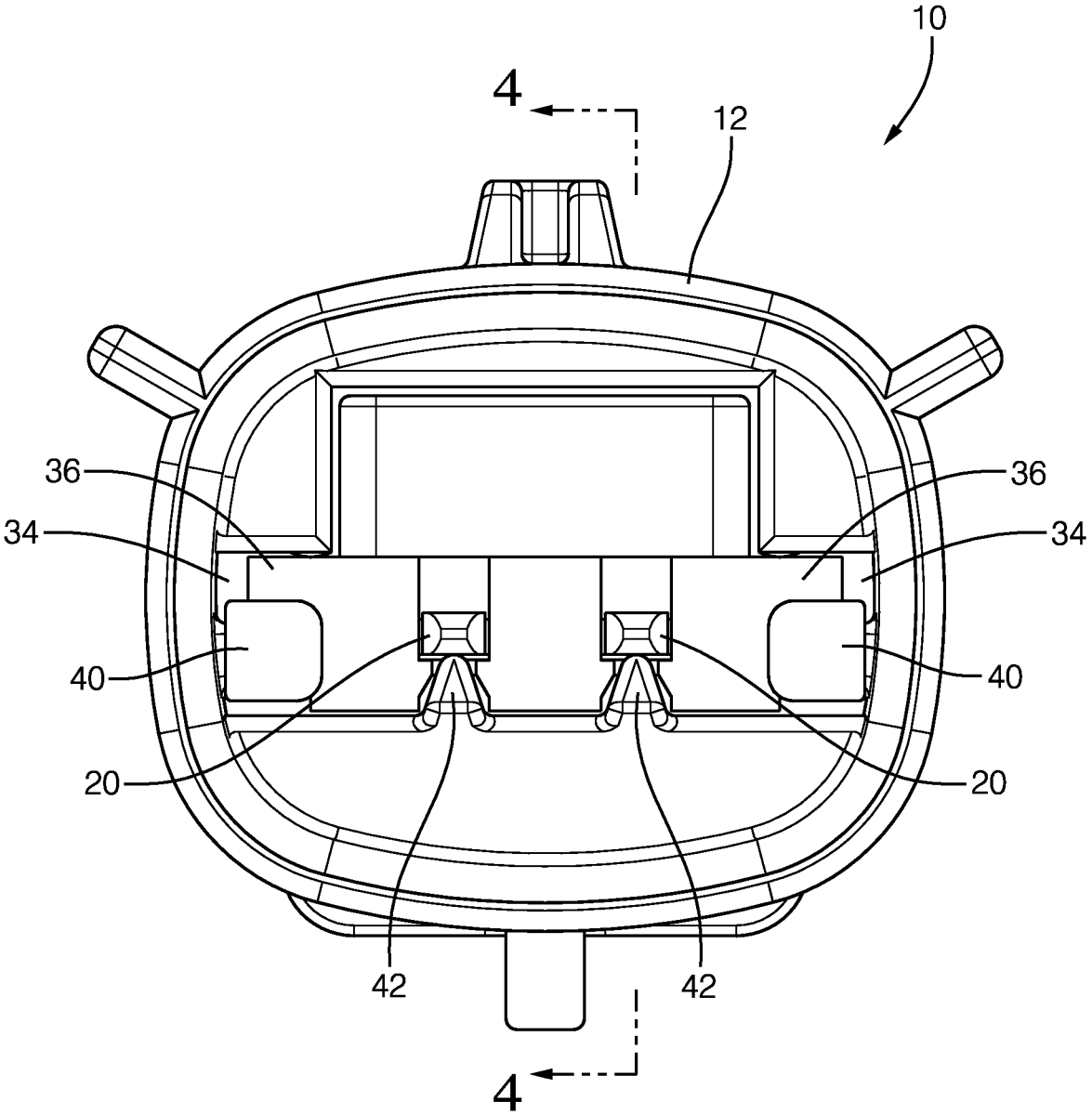
FIG. 3 is an end view of the electrical connector assembly of FIG. 1 after deformation of the longitudinal wings in accordance with one embodiment of the invention.
Figure 4:
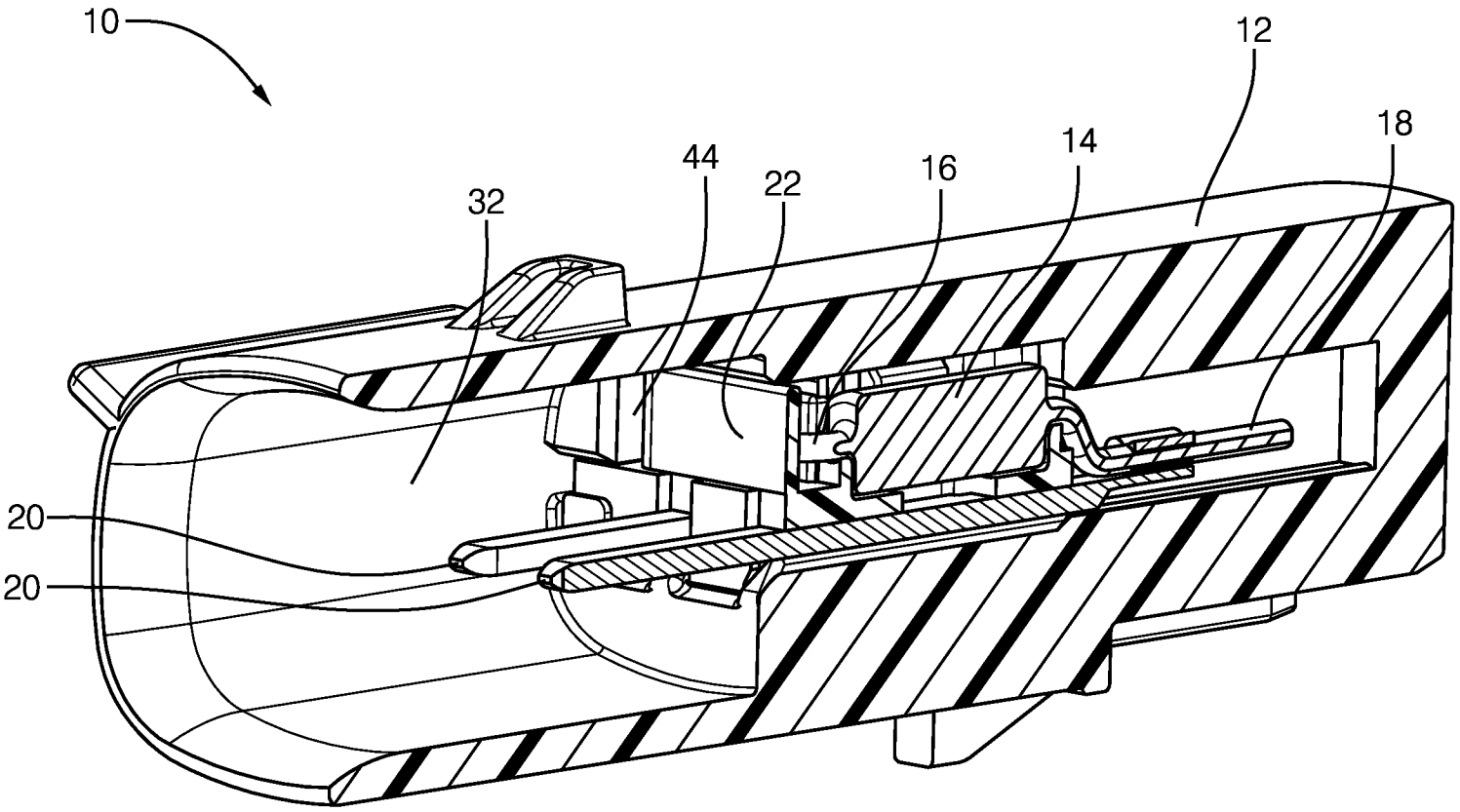
FIG. 4 is a side cross-sectional view of the electrical connector assembly of FIG. 1 in accordance with one embodiment of the invention.

As shown in FIG. 3, portions 40 of the side walls are deformed so that they overlay the ends of the longitudinal wings 36 after the retainer subassembly 30 is placed within the cavity 32 in order to inhibit later removal of the retainer subassembly 30 from the connector body 12. The portions 40 of the side walls may be deformed using a heat staking or cold staking process.

A bottom wall of the cavity 32 defines a pair of longitudinal index ribs 42 having a generally triangular cross section that extend from a bottom wall of the cavity 32 in to the pair of longitudinal channels 24 of the retainer housing 22. The bases of the longitudinal index ribs 42 are adjacent the bottom wall of the cavity 32 and the apices of the longitudinal index ribs 42 are adjacent the electrical terminals 20. The apices of the longitudinal index ribs 42 are in compressive contact with the first and second electrical terminals 20. The interaction of the longitudinal index ribs 42 and the electrical terminals 20 inhibit movement of the electrical terminals 20 relative to the connector body 12, thereby providing the benefit of improved alignment of the electrical terminals 20 with the connector body 12 which improves the likelihood of proper mating of the electrical terminals 20 and the corresponding terminals in the corresponding connector body.

As best shown in FIG. 6, the connector body 12 defines a central wall 44 extending into the cavity 32. When the retainer subassembly 30 is disposed within the cavity 32, this central wall 44 is located intermediate the first wire lead 16 and the second wire lead 18 of the electrical component 14. This central wall 44 prevents inadvertent contact between the first and second wire leads 16, 18 which would short circuit the electrical component 14.

While the illustrated example shows a connector body including only the two terminals in the retainer subassembly 30, other embodiments may have more than two terminals incorporated into additional retainer subassemblies or attached to wire cables.

Accordingly, an electrical connector assembly 10 including an electrical component 14, such as a terminating resistor, is provided. The assembly 10 provides the benefits of improved alignment of the electrical terminals 20 relative to the connector body 12 which improves mating of the electrical terminals 20. The assembly 10 also provides the benefits of being more easily automated than prior methods of assembling similar assemblies.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

We claim:

1. An electrical connector assembly, comprising:

a connector body defining a cavity within;

an electrical component having a generally cylindrical body and a first wire lead extending axially from a first end of the cylindrical body and a second wire lead extending axially from a second end of the cylindrical body;

a first and second electrical terminal, said first wire lead in contact with the first electrical terminal and said second wire lead in contact with the second electrical terminal;

a retainer housing disposed within the cavity, wherein the retainer housing defines a pair of longitudinal channels in which the first and second electrical terminals are disposed, wherein the retainer housing defines a cradle having an arcuate cross section in which the electrical component is disposed, and wherein the retainer housing defines a retaining feature securing the electrical component to the cradle.

2. The electrical connector assembly in accordance with claim 1, wherein the electrical component is a resistor.

3. The electrical connector assembly in accordance with claim 1, wherein the first and second wire leads are welded to the first and second electrical terminals.

4. The electrical connector assembly in accordance with claim 3, wherein the first and second wire leads are resistance welded to the first and second electrical terminals.

5. The electrical connector assembly in accordance with claim 1, wherein a side wall of the connector body defines a longitudinal groove and the longitudinal groove defines a longitudinal crush rib projecting from an inner surface of the longitudinal groove, wherein an adjoining side wall of the retainer housing defines a longitudinal wing extending therefrom and disposed within the longitudinal groove, and wherein the longitudinal crush rib is in compressive contact with the longitudinal wing.

6. The electrical connector assembly in accordance with claim 5, wherein a portion of the side wall is deformed and overlaying an end of the longitudinal wing.

7. The electrical connector assembly in accordance with claim 1, wherein a bottom wall of the connector cavity defines a pair of longitudinal index ribs that extends in to the pair of longitudinal channels and wherein the pair of longitudinal index ribs are in contact with and in an interface fit with the first and second electrical terminals.

8. The electrical connector assembly in accordance with claim 7, wherein the pair of longitudinal index ribs each have a generally triangular profile in cross section.

9. The electrical connector assembly in accordance with claim 8, wherein the J-shaped bend is formed such that a free end of the first wire lead is arranged alongside and essentially parallel to the second wire lead.

10. The electrical connector assembly in accordance with claim 1, wherein the first wire lead has a J-shaped bend.

11. The electrical connector assembly in accordance with claim 1, wherein the connector body defines a central wall within the cavity disposed intermediate the first and second wire leads.

12. The electrical connector assembly in accordance with claim 1, wherein the first electrical terminal is arranged alongside and essentially parallel to the second electrical terminal.

13. The electrical connector assembly in accordance with claim 1, wherein the retaining feature defines a pair of flexible arms securing the electrical component within the cradle.

14. The electrical connector assembly in accordance with claim 13, wherein one flexible arm of the pair of flexible arms is disposed intermediate the electrical component and the free end of the first wire lead.

15. The electrical connector assembly in accordance with claim 1, wherein the first and second electrical terminals extend into the cavity.

* * * * *